US005113743A

United States Patent [19]

Higashi

[11] Patent Number: 5,113,743

[45] Date of Patent: May 19, 1992

[54] MUSICAL TONE SYNTHESIZING APPARATUS

[75] Inventor: Iwao Higashi, Hamamatsu, Japan

[73] Assignee: Yamaha Corporation, Hamamatsu, Japan

[21] Appl. No.: 553,867

[22] Filed: Jul. 16, 1990

[30] Foreign Application Priority Data

Jul. 18, 1989 [JP] Japan ..... 1-185196

[51] Int. Cl.[5] ..... G10H 5/07

[52] U.S. Cl. ..... 84/622; 84/630; 84/659; 84/DIG. 26

[58] Field of Search ..... 84/630, 622, 624, 625, 84/659-661, DIG. 9, DIG. 26

[56] References Cited

U.S. PATENT DOCUMENTS 4,475,229 10/1984 Frese ..... 84/DIG. 26

4,984,276 1/1991 Smith ..... 84/630 X

FOREIGN PATENT DOCUMENTS 63-40199 2/1988 Japan .

*Primary Examiner*—William M. Shoop, Jr.

*Assistant Examiner*—Brian Sircus

*Attorney, Agent, or Firm*—Graham & James

[57] ABSTRACT

The musical tone synthesizing apparatus simulating the wind instrument synthesizes a musical tone signal to thereby generate a musical tone corresponding to the wind instrument tone. Herein, the musical tone synthesizing apparatus contains one or more stages each including a bi-directional transmission circuit and a junction. In each stage, the progressive wave signal is delayed by the predetermined delay time and transmitted to the junction. The junction multiplies the signal by first coefficient, whereby the result of multiplication is transmitted to the next stage. The junction also multiplies the progressive wave signal by second coefficient, whereby the result of multiplication is fed back to the prior stage. The first and second coefficients are changed over according to an operation of a tone hole to be provided in the wind instrument. Thus, the musical tone of the wind instrument can be simulated with simple circuit or software.

9 Claims, 3 Drawing Sheets

MUSICAL TONE SYNTHESIZING APPARATUS

BACKGROUND OF THE INVENTION

1. Field of the Invention

The present invention relates to a musical tone synthesizing apparatus which is suitable for electric wind instruments and the like.

2. Prior Art

Conventionally, a method for synthesizing a musical tone by operating the simulation model of the sound generation mechanism of non-electronic musical instrument is well known. Such method is disclosed in Japanese Patent Laid-Open Publication No. 63-40199, for example. Hereinafter, description will be given with respect to the simulation model of the sound generation mechanism of wind instrument and then description will be further given with respect to the musical tone synthesizing apparatus utilizing such simulation model.

FIG. 1 is a sectional view showing diagrammatical construction of the wind instrument such as the clarinet, saxophone, etc. In FIG. 1, 1 designates a resonance tube of the wind instrument and 2 designates a reed. In addition, TH designates a tone hole formed through the resonance tube 1, by which a tone pitch is to be controlled.

When a performer blows his breath 2A into the reed 2, the reed 2 is vibrated by breath pressure PA and elastic character thereof in a direction as shown by 2S. As a result, pressure wave of air (i.e. compression wave of air) is produced in the tube 1 near the reed 2. Such pressure wave of air is transmitted to a terminal portion 1E of the tube 1 as progressive pressure wave F. Then the progressive pressure wave F is reflected at several portions and terminal portion 1E of the tube 1. Thereafter, reflected pressure wave R is returned to the reed 2, so that pressure PR due to the reflected pressure wave R is applied to the reed 2. Therefore, the whole pressure P to be applied to the reed 2 can be calculated by the following formula (1).

$$P = PA - PR \quad (1).$$

Thus, the reed 2 is subject to the non-linear vibration which depends on the elastic characteristic thereof and whole pressure P. When the resonance state is stablished between the vibration of reed 2 and reciprocating motion of the pressure waves F, R in the resonance tube 1, the musical tone of the wind instrument is to be generated.

In this case, the resonance frequency is changed over by open/close operation of the tone hole TH formed through the tube 1. More specifically, when the open/close operation is carried out on the tone hole TH by the performer's finger, the flow of the compression wave is varied in the vicinity of the tone hole TH so that the substantial columnar length in the tube is varied, whereby the resonance frequency is to be changed over.

FIG. 2 shows the musical tone synthesizing apparatus whose configuration is obtained by simulating the sound generation mechanism of the wind instrument. In FIG. 2, 11 designates a ROM which stores a non-linear function representing the relationship between the whole pressure P and pressure wave of air generated by the reed 2; 12 designates a resonance circuit which simulate the resonance tube 1; 13 designates an adder; and INV designates an inverter. Herein, data VA which corresponding to the breath pressure PA is applied to the adder 13, while output data PR from the resonance circuit 12 is applied to the adder 13 via the inverter INV. Thus, the addition as shown in the foregoing formula (1) is carried out in the adder 13, and the result thereof corresponding to the whole pressure P is applied to the ROM 11 as its address data. Therefore, the ROM 11 outputs data corresponding to the pressure wave of air, which is then applied to the resonance circuit 12.

In the resonance circuit 12, $BD_1$, $BD_2$, . . . designate bi-directional transmission circuits each simulating the transmission delay characteristic of the compression wave of air which propagates in the resonance tube 1. In each of the bi-directional transmission circuit $BD_1$, $BD_2$, etc., $DF_1$, $DF_2$, . . . designate delay circuits for transmitting the progressive wave signal, and $DR_1$, $DR_2$, . . . designate delay circuits for transmitting the reflected wave signal. Each of delay circuits $DR_1$, $DR_2$, . . . contains some flip-flops of which number is corresponds to the bit number of the transmitted data each driven by the clock having the predetermined period. Further, TRM designates a terminal circuit which simulates the reflection of the compressive wave of air which is reflected at the terminal portion 1E of the resonance tube 1 (see FIG. 1). This terminal circuit TRM consists of a low-pass filter ML and an inverter IV. Herein, the low-pass filter ML simulates the acoustic loss which is occurred due to the reflection of compression wave, while the inverter IV simulates the phase inversion of the compression wave to be reflected. Incidentally, this inverter IV is not required when the terminal portion 1E is closed but required when the terminal portion 1E is opened.

Furthermore, $JU_1$ designates a junction which simulates the scattering of the compression wave in the vicinity of the tone hole TH. In $JU_1$, $M_1$, $M_2$ designate multipliers; $A_1$, $A_2$ designate subtractors; and $A_j$ an adder. The delay circuit $DF_1$ in the bi-directional transmission circuit $BD_1$ outputs progressive wave data $F_1$ to the multiplier $M_1$ wherein $F_1$ is multiplied by a coefficient $a_1$ so that multiplication result $a_1F_1$ is sent to the adder $A_j$. On the other hand, the delay circuit $DR_2$ in the bi-directional transmission circuit $BD_2$ outputs reflected wave signal $R_2$ to the multiplier $M_2$ wherein $R_2$ is multiplied by another coefficient $a_2$ so that multiplication result $a_2R_1$ is obtained. Herein the coefficients $a_1$, $a_2$ will be described later in detail. The adder $A_j$ adds these two multiplication results together, and then its addition result is supplied to both of the subtractors $A_1$, $A_2$. The subtractor $A_1$ subtracts $F_1$ from the addition result of adder $A_j$ to thereby output its subtraction result to the delay circuit $DR_1$ in the bi-directional transmission circuit $BD_1$ as reflected wave data $R_1$. On the other hand, the subtractor $A_2$ subtracts $R_2$ from the addition result of $A_j$ to thereby output its subtraction result to delay circuit $DF_2$ in the bi-directional transmission circuit $BD_2$ as progressive wave data $F_2$. Further, other junction circuits which are constructed similar to the junction circuit $JU_1$ for simulating other tone holes in the tube 1, are inserted between $BD_2$ and TRM at corresponding positions of the tone holes.

Next, description will be given with respect to the coefficients a1, to be used in the multipliers M1, M2 with respect to the following two cases.

(i) First Case where the tone hole TH is opened:

The following formula (2) represents air pressure Pj at point j which is set in the vicinity of the tone hole TH in the tube 1 shown in FIG. 1.

$$Pj = a_1\text{off}\ P_{1+} + a_2\text{off}\ P_{2+} \quad (2).$$

Herein, $P_{1+}$ designates the pressure of the compression wave which enters into the point j from the reed 2, while $P_{2+}$ designates another pressure of the compression wave which enters into the point j from the terminal portion 1E. In addition, $a_1$off, $a_2$off designate ratios of two pressures of compression waves, which can be represented by the following formulae (3), (4) respectively.

$$a_1\text{off} = 2\phi_1^2/(\phi_1^2+\phi_2^2+\phi_3^2) \quad (3)$$

$$a_2\text{off} = 2\phi_2^2/(\phi_1^2+\phi_2^2+\phi_3^2) \quad (4).$$

In the above formulae, $\phi_1$ designates the diameter of the tube 1 in reed side; $\phi_2$ designates the diameter of the tube 1 in terminal side; and $\phi_3$ designates the diameter of the tone hole TH. In FIG. 2, the progressive wave signal $F_1$ corresponds to the pressure $P_{1+}$, while the reflected wave signal $R_2$ corresponds to the pressure $P_{2+}$. In this first case where the tone hole TH is opened, the above-mentioned coefficients $a_1$off, $a_2$off are used as the foregoing coefficients $a_1$, $a_2$ of the multipliers $M_1$, $M_2$ respectively. For this reason, the adder Aj can output the operation result of foregoing formula (2), i.e., signal corresponding to the air pressure Pj at the point j in the tube 1.

Meanwhile, the following formulae (5), (6) respectively represent pressure $P_{1-}$ of the reflected compression wave which flows from the point j toward the reed 2 and pressure $P_{2-}$ of the progressive compression wave which flows from the point j toward the terminal portion 1E.

$$P_{1-} = Pj - P_{1+} \quad (5)$$

$$P_{2-} = Pj - P_{2+} \quad (6).$$

Thus, these pressures $P_{1-}$, $P_{2-}$ correspond to the outputs of the subtractors $A_1$, $A_2$ respectively.

(ii) Second Case where the tone hole TH is closed:

This case is equivalent to the state where the diameter $\phi_3$ of the tone hole TH is at "0". Therefore, coefficients $a_1$on, $a_2$on can be obtained by putting "$\phi_3=0$" in the foregoing formulae (3), (4) respectively.

$$a_1\text{on} = 2\phi_1^2/(\phi_1^2+\phi_2^2) \quad (7)$$

$$a_2\text{on} = 2\phi_2^2/(\phi_1^2+\phi_2^2) \quad (8).$$

These coefficients $a_1$on, $a_2$on are used as the foregoing coefficients $a_1$, $a_2$ of the multipliers $M_1$, $M_2$.

Thus, the adder Aj can output the signal corresponding to the air pressure Pj at the point j of the tube 1 in accordance with the following formula (9).

$$Pj = a_1\text{on}\ P_{1+} + a_2\text{on}\ P_{2+} \quad (9).$$

Then, the subtractors $A_1$, $A_2$ output signals corresponding to the pressures $P_{1-}$, $P_{2-}$.

As described heretofore, the circuit shown in FIG. 2 can simulate the scattering state of the compression wave in the tube 1 in response to the open/close operation of the tone hole TH.

In the present example of the conventional musical tone synthesizing apparatus, the data VA corresponding to the blowing pressure PA is applied to the ROM 11 via the subtractor 13. The output signal of the ROM 11 is transmitted to the terminal circuit TRM via the bi-directional transmission circuits $BD_1$, $BD_2$ and junction circuit $JU_1$ etc. In the junction circuit $JU_1$, values of the coefficients $a_1$, $a_2$ are changed over in response to the open/close operation of the tone hole TH as described before, and consequently the scattering state in the junction circuit $JU_1$ is changed over. The progressive wave data reached at the terminal circuit TRM is processed by the low-pass filter ML and inverter IV so that the reflected wave data is obtained.

The reflected wave data is transmitted through the bi-directional circuits $BD_n$, . . . , $BD_2$, $BD_1$ (Where, $BD_n$, not shown, designates a bi-directional circuit which is most adjacent to the terminal circuit TRM); junctions $JU_1$, etc. which are inserted between the corresponding bi-directional circuits. Then, the inverter INV inverts sign of the reflected wave data. Thereafter, the reflected wave data is fed back to the adder 13 so that this circuit shown in FIG. 2 is set in a resonance state. In this case, the resonance frequency can be changed over by changing over the coefficients $a_1$, $a_2$ used in the junction circuit $JU_1$ in response to the open/close state of the tone hole TH.

However, the above-mentioned junction circuit requires two multipliers, two subtractors, and one adder for simulating one tone hole. Therefore, there is a problem in that the hardware of conventional apparatus must be enlarged. In contrast, when the above-mentioned operational process is carried out by the software to be executed by the digital signal processor (DSP) and the like, there is a problem in that the amount of software operations must be increased.

SUMMARY OF THE INVENTION

It is accordingly a primary object of the present invention to provide a musical tone synthesizing apparatus which can simulate the real scattering to the musical tone in the wind instrument.

It is another object of the present invention to provide a musical tone synthesizing apparatus capable of carrying out the operational process of the signal corresponding to the pressure wave of air with reduced amount of operations.

In a first aspect of the present invention, there is provided a musical tone synthesizing apparatus comprising:

(a) excitation means for outputting an excitation signal based on an input signal thereof;

(b) bi-directional transmission means for transmitting the excitation signal outputted from the excitation means as a progressive wave signal and also feeding back the progressive wave signal to the excitation means as a reflected wave signal;

(c) tone pitch information generating means for generating first and second coefficients corresponding to tone pitch information representative of tone pitches of a musical tone to be generated; and (d) operation means to be inserted at a predetermined position of the bi-directional transmission means, the operation means carrying out multiplication on the progressive wave signal by use of the first coefficient, adding result of the multiplication to the reflected wave signal so that an addition result is transmitted toward the excitation means as a new reflected wave signal, and multiplying the progressive wave signal by the second coefficient so that its multiplication result is to be transmitted as a new progressive wave signal.

In a second aspect of the present invention, there is provided a musical tone synthesizing apparatus comprising:

(a) excitation means for outputting an excitation signal based on an input signal thereof;

(b) bi-directional transmission means for transmitting the excitation signal outputted from the excitation means as a progressive wave signal and also feeding back the progressive wave signal to the excitation means as a reflected wave signal;

(c) tone pitch information generating means for generating a coefficient corresponding to tone pitch information representative of tone pitches of a musical tone to be generated;

(d) filter means for generating a filtered signal by changing frequency characteristic of the progressive wave signal at a predetermined position of the bi-directional transmission circuit;

(e) adding means for generating an addition result of the filtered signal and the reflected wave signal at the position as a new reflected wave signal; and (f) multiplying means for generating a multiplication result of the progressive wave signal at the position by the coefficient as a new progressive wave signal.

In a third aspect of the present invention, there is provided a musical tone synthesizing apparatus comprising:

(a) excitation means for outputting an excitation signal based on an input signal thereof;

(b) bi-directional transmission means for transmitting the excitation signal outputted from the excitation means as a progressive wave signal and also feeding back the progressive wave signal to the excitation means as a reflected wave signal, the bi-directional transmission means containing delay means which delays the progressive wave signal;

(c) tone pitch information generating means for generating coefficients corresponding to tone pitch information representative of tone pitches of a musical tone to be generated;

(d) filter means for generating a filtered signal by changing frequency characteristic of the progressive wave signal at a predetermined position of the bi-directional transmission circuit;

(e) adding means for generating an addition result of the filtered signal and the reflected wave signal at the position as a new reflected wave signal; and (f) multiplying means for generating a multiplication result of the progressive wave signal at the position by the coefficient as a new progressive wave signal.

BRIEF DESCRIPTION OF THE DRAWINGS

Further objects and advantages of the present invention will be apparent from the following description, reference being had to the accompanying drawings wherein preferred embodiments of the present invention are clearly shown.

In the drawings.

DESCRIPTION OF THE PREFERRED EMBODIMENTS

Next, description will be given with respect to the preferred embodiment of the present invention.

A

FIRST EMBODIMENT

Figure 1:
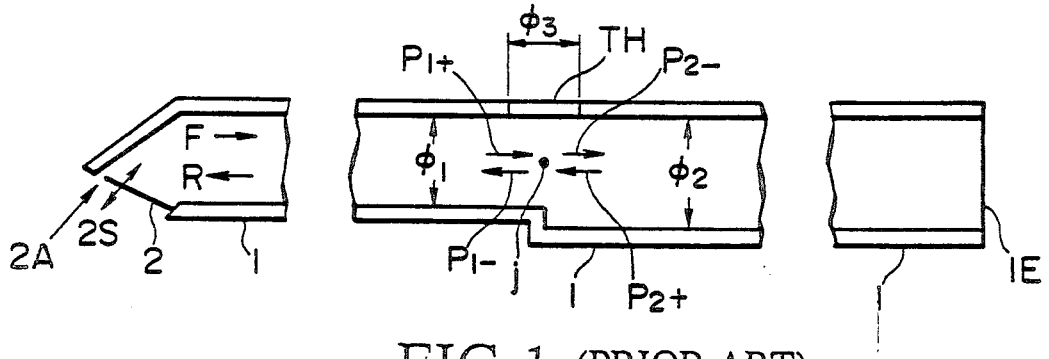
FIG. 1 (PRIOR ART)
FIG. 1 is a sectional view showing the diagrammatical construction of the wind instrument.
Figure 2:
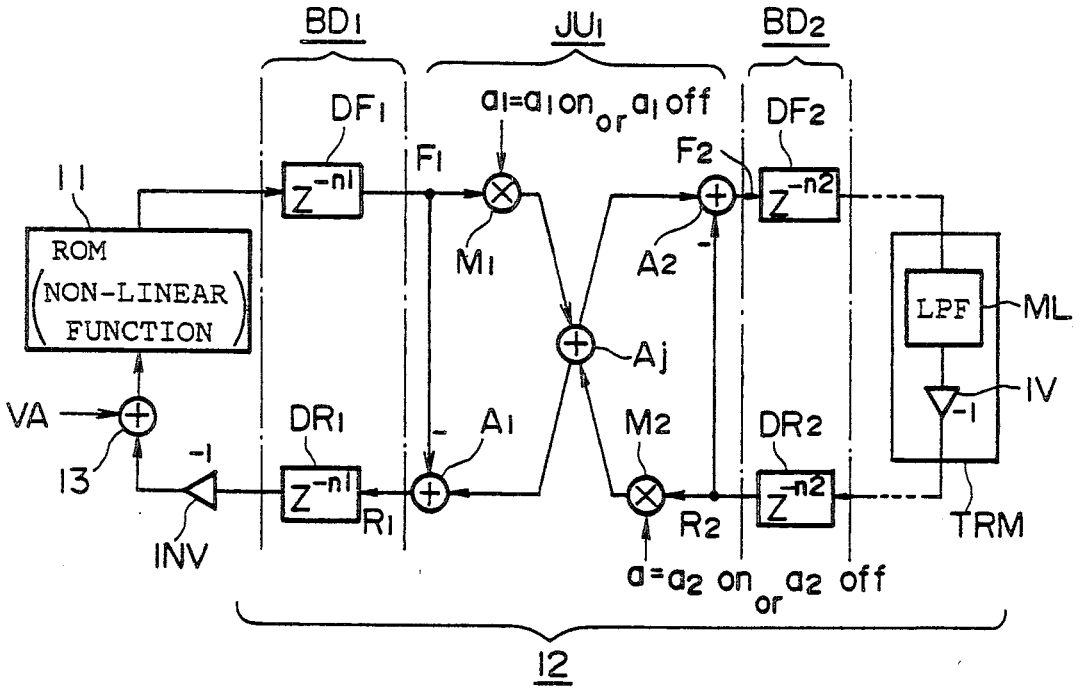
FIG. 2 (PRIOR ART)
FIG. 2 is a block diagram showing the electric configuration of the conventional musical tone synthesizing apparatus.
Figure 3:
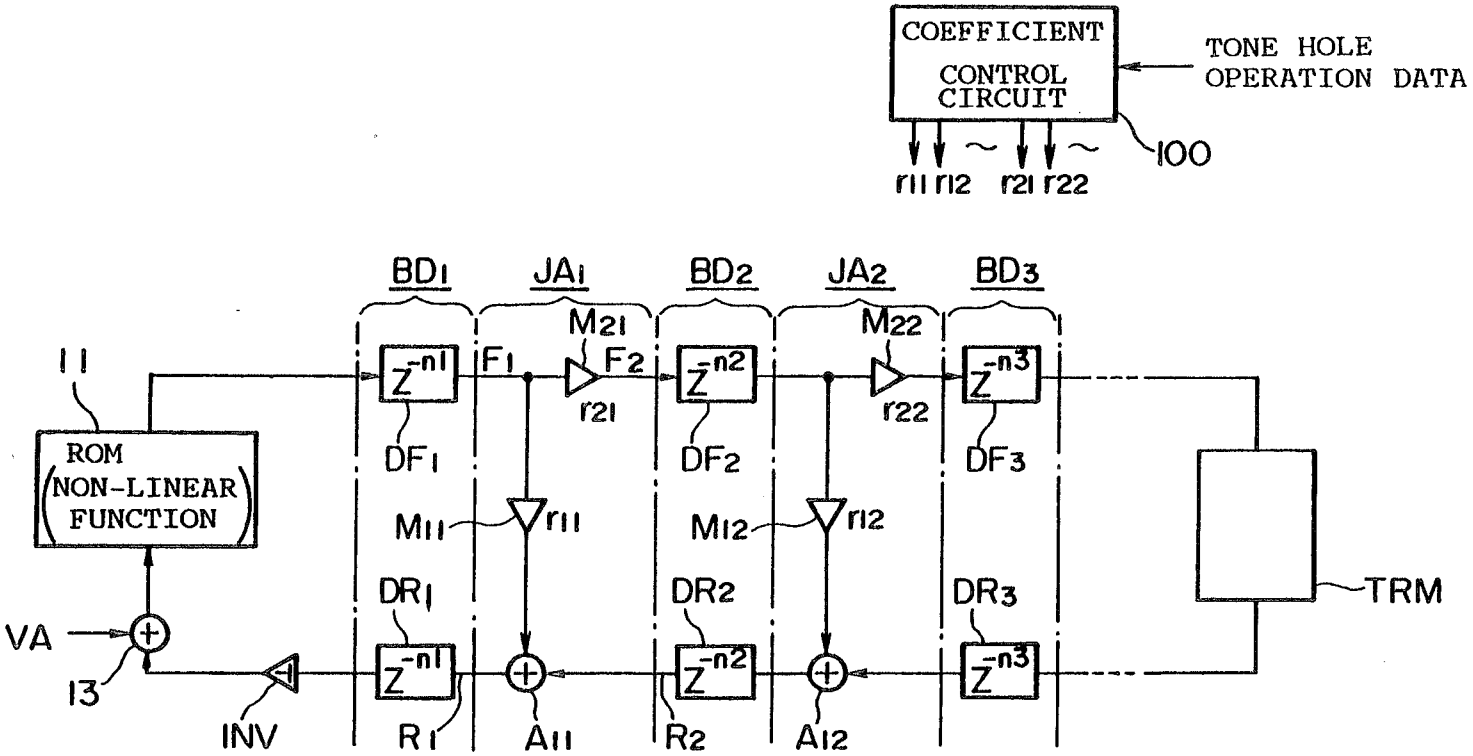
FIG. 3 is a block diagram showing an electric configuration of the musical tone synthesized apparatus according to a first embodiment of the present invention.

FIG. 3 is a block diagram showing the electric configuration of the musical tone synthesizing apparatus according to the first embodiment of the present invention, wherein parts identical to those shown in FIG. 2 will be designated by the same numerals, hence, description thereof will be omitted.

In FIG. 3, $JA_1$ designates a junction for carrying out the simulation of a first tone hole (i.e., a tone hole which is the most adjacent to the reed). Junction $JA_1$ multiplies coefficient $r_{21}$ by progressive wave data $F_1$ which obtained from a bi-directional transmission circuit $BD_1$, by using a multiplier $M_{21}$. Then, the result of the multiplication is transmitted to the bi-directional transmission circuit $BD_2$ as progressive wave data $F_2$. The junction $JA_1$ also multiplies coefficient $r_{11}$ by the progressive wave data $F_1$ by using a multiplier $M_{11}$, and adds the result of multiplication ($r_{11}F_{11}$) to reflected wave data $R_2$ which is obtained from a bi-directional transmission circuit $BD_2$ by using an adder $A_{11}$, and transmits the result of the addition ($R_2+r_{11}F_{11}$) to the bi-directional transmission circuit $BD_1$ as reflected wave data $R_1$. Junctions $JA_2$ and additional junctions (not shown) simulate the other tone holes, and they are configured similar to the junction $JA_1$. Herein, each of coefficients $r_{11}$, $r_{21}$, $r_{12}$, $r_{22}$ (and coefficients for other junctions) to be supplied to the corresponding multipliers $M_{11}$, $M_{21}$, $M_{12}$, $M_{22}$ (and multipliers for other junctions) are switched by a coefficient control circuit 100 in accordance with tone hole operation data. More specifically, in the case where the first tone hole is closed, the coefficient $r_{21}$ is set to a relatively large value and the coefficient $r_{11}$ is set to a relatively small value. On the other hand, in the case where the first tone hole is opened, the coefficient $r_{21}$ is set to a relatively small value and the coefficient $r_{11}$ is set to a relatively large value. Each coefficient is changed over between two values, in which one value corresponds to full-open state and the other corresponds to full-close state. Alternatively, the value of each coefficient may be continuously varied in response to the opening area of the corresponding tone hole.

According to this musical synthesizing apparatus of this embodiment, for example, in the case where the first tone hole is opened, output data of ROM 11 is transmitted to the junction $JA_1$ wherein the output data is attenuated by a pre-specified attenuation ratio. Next, the attenuated output data is returned toward the adder 13. On the other hand, in a bi-directional transmission circuit $BD_2$ which is located at next stage, the progressive wave data from ROM 11 is attenuated to a very small value. Hence, in this case, the reflected wave data, which is returned to the adder 13 equals to the sum of data which are reflected at junctions $JA_1$, $JA_2$, (and other junctions) and the terminal circuit TRM, wherein the data reflected at the junction $JA_1$ is the largest. Consequently, tone pitch is determined in accordance with the reciprocation period of the data which is transmitted through the transmission circuit $BD_1$. Furthermore, in this case, reflected data from respective parts excepting the junction $JA_1$ are also returned to the adder 13. Hence, propagation of pressure wave in certain wind instrument is simulated with high-fidelity. Next, in another case where the first tone hole is closed and the second tone hole is opened, output data of ROM 11 is slightly attenuated at the junction $JA_1$, and then reached to the junction $JA_2$. Such output data is transmitted through the junction $JA_2$, and returned. Consequently, tone pitch is determined in accordance with the reciprocation period of the data which is transmitted through the transmission circuits $BD_1$, $BD_2$. Furthermore, in other cases where other tone holes are opened, similar operations are carried out. Thus, according to the musical synthesizing apparatus of this embodiment, both of the propagation of pressure wave which is transmitted toward the terminal portion in certain wind instrument and the propagation of pressure wave which is reflected at the terminal portion and transmitted toward the reed are simulated faithfully with reduced amount of hardware or software operations.

B

SECOND EMBODIMENT

Figure 4:
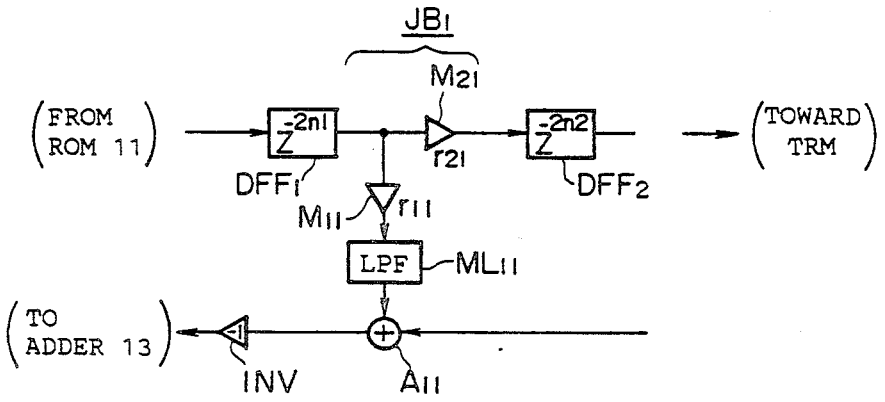
FIG. 4 is a block diagram showing an electric configuration of the musical tone synthesized apparatus according to a second embodiment of the present invention.

FIG. 4 is a block diagram showing the electric configuration of the musical tone synthesizing apparatus according to the second embodiment of the present invention. First of all, the above-mentioned first embodiment contains delay circuits for both progressive wave data and reflected wave data. In contrast, in the second embodiment of the present invention, only progressive wave data is delayed by delay circuits $DEF_1$, $DEF_2$, . . . and $DEF_m$ transmitted to the terminal circuit TRM. Each delay circuit $DEF_i$ (where i=1 to n) have a delay time that equals to each sum of the delay times of $DF_i$ and $DR_i$ in the first embodiment of the invention. Thus, according to above-mentioned construction, similar operation of the first embodiment is executed. Moreover, as shown in FIG. 4, this embodiment contains a junction $JB_1$ instead of the junction $JA_1$ in FIG. 3. The junction $JB_1$ contains a low-pass filter (LPF) $ML_{11}$ for filtering the output data of multiplier $M_{11}$ in order to simulate the sound-loss at the tone hole. The junction $JB_1$ includes multipliers $M_{11}$ and $M_{21}$ having coefficients r11 and r21 respectively.

Thus, according to this embodiment, smaller scale of apparatus is achieved as compared with the first embodiment, by decreasing the number of delay circuits. Or, in the case where the DSP is adopted for the musical tone synthesizing operation, smaller amount of software is achieved as compared with the first embodiment.

C

THIRD EMBODIMENT

Figure 5:
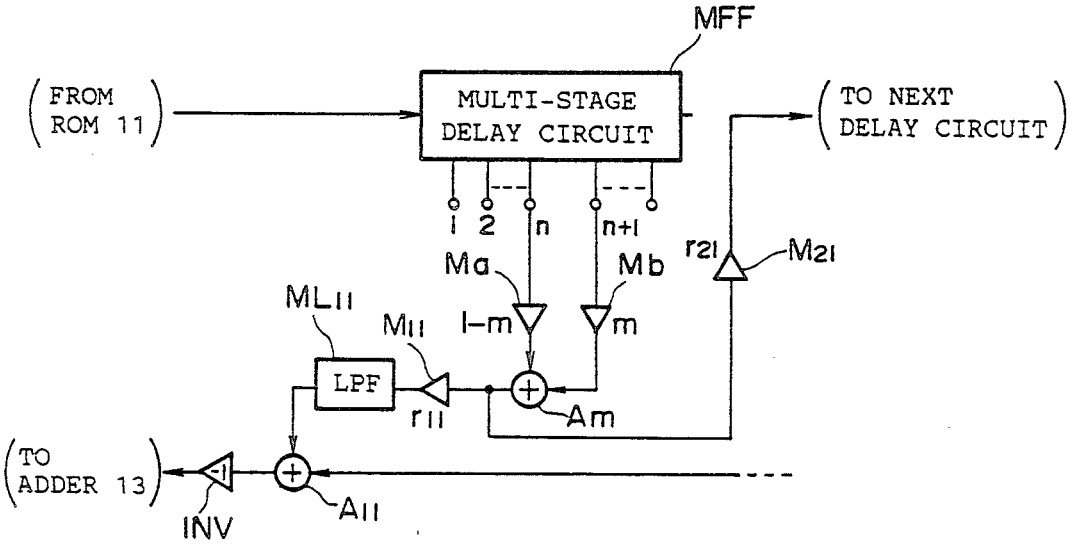
FIG. 5 is a block diagram showing an electric configuration of the musical tone synthesized apparatus according to a third embodiment of the present invention.

FIG. 5 is a block diagram showing the electric configuration of the musical tone synthesizing apparatus according to the third embodiment of the present invention. First of all, in the above-mentioned second embodiment, the output data of the delay circuit $DFF_1$ is supplied to the multiplier $M_{11}$. In contrast, in the third embodiment of the present invention, multi-stage delay circuit MFF is adopted instead of the delay circuits $DFF_1$ and $DFF_2$ in the second embodiment. Herein, the output data at n-th stage and (n+1)-th stage of the MFF are picked-up, and the picked-up data are multiplied by coefficients (1−m) and m at multipliers Ma and Mb respectively. Next, the results of multiplications are added together by an adder Am. Then the addition result of Am is supplied to an multiplier $M_{11}$. In the multi-stage delay circuit MFF, data output points (e.g., n-th and (n+1)-th stages in FIG. 5) are determined in accordance with approximate positions of tone holes formed in the wind instrument. The coefficients (m−1) and m are the coefficients which are obtained by carrying out the linear interpolation on the progressive wave data based on the output data from n-th and (n+1)-th stages of MFF according to the exact positions of the tone holes. Each coefficient has the decimal value which ranges from 0 to 1. Therefore, data FT which is outputted from the adder Am can be represented by the following formula (10).

$$FT=(1-m)F(n)+mF(n+1) \quad (10).$$

In the above formula, F(n) designates the output data of n-th stage, and F(n+1) designates the output data of (n+1)-th stage. Therefore, progressive wave data which simulates the actual pressure wave of air at the tone hole is obtained, and transmitted to the multiplier $M_{11}$ and $M_{21}$. Hence, according to this embodiment, it is possible to synthesize the musical tone corresponding to the exact positions of the tone holes.

Furthermore, according to this embodiment, musical tone synthesizing control corresponding to the pitch-bend and vibrato performance, is applicable. That is to say, in the case where the pitch-bend performance is simulated, coefficients (1−m) and m are varied in accordance with certain curve at the beginning of tone-generation, and they are converged to values corresponding to the actual positions of tone holes after certain time has passed. Hence, at the beginning of tone-generation, the tone pitch of the sound is varied, so that the pitch-bend performance can be simulated. Further, in another case where the vibrato is simulated, coefficients (1−m) and m are varied in accordance with to a certain sine curve. Herein, tone pitch of the sound is varied, so that the vibrato performance can be simulated.

In the embodiments described heretofore, the non-linear function is realized by ROM 11. However, it is possible to embody the non-linear function by use of random-access memory (RAM), operation circuit and other non-linear elements. Of course, the present embodiments are not limited to synthesize the wind instrument tone, hence, it is possible to synthesize the stringed instrument tone in which the size of string is not constant in one string, and also synthesize the reverberation effect applied tone and the like in the complicated three-dimensional space.

As described heretofore, this invention may be practiced or embodied in still other ways without departing from the spirit or essential character thereof. Therefore, the preferred embodiments described herein are illustrative and not restrictive, the scope of the invention being indicated by the appended claims and all variations which come within the meaning of the claims are intended to be embraced therein.

What is claimed is:

1. A musical tone synthesizing apparatus comprising:
(a) excitation means for outputting an excitation signal based on an input signal applied thereto;
(b) a plurality of bi-directional transmission means for transmitting said excitation signal output away from said excitation means as a progressive wave signal and also feeding back said progressive wave signal toward said excitation means as a reflected wave signal;
(c) tone pitch information generating means for generating first and second coefficients corresponding to tone pitch information representative of the pitch of a musical tone to be generated; and
(d) at least one operation means, each inserted between two of said bi-directional transmission means, for multiplying said progressive wave signal by said first coefficient, adding the result of the multiplication to said reflected wave signal so that an addition result is transmitted toward said excitation means as a new reflected wave signal, and multiplying said progressive wave signal by said second coefficient so that the multiplication result is transmitted as a new progressive wave signal.

2. A musical tone synthesizing apparatus according to claim 1 wherein each of said bi-directional transmission means delays at least one of said progressive wave signal and said reflected wave signal.

3. A musical tone synthesizing apparatus comprising:
(a) excitation means for outputting an excitation signal based on an input signal applied thereto;
(b) bi-directional transmission means having a progressive path for transmitting said excitation signal output from said excitation means as a progressive wave signal and a reflective path for feeding back said progressive wave signal to said excitation means as a reflected wave signal;
(c) tone pitch information generating means for generating a first coefficient corresponding to tone pitch information representative of the pitch of a musical tone to be generated;
(d) filter means located between the progressive path and the reflective path for generating a filtered signal by changing frequency characteristics of said progressive wave signal;
(e) adding means for adding said filtered signal and said reflected wave signal to generate a new reflected wave signal; and
(f) first multiplying means for multiplying said progressive wave signal by said first coefficient to generate a new progressive wave signal.

4. A musical tone synthesizing apparatus according to claim 3 further comprising second multiplying means wherein said tone pitch information generating means generates a second coefficient corresponding to the tone pitch information, wherein said second multiplying means multiplies one of said filtered signal and said progressive wave signal by said second coefficient.

5. A musical tone synthesizing apparatus according to claim 3 wherein said bi-directional transmission means delays at least one of said progressive wave signal and said reflected wave signal.

6. A musical tone synthesizing apparatus comprising:
(a) excitation means for outputting an excitation signal based on an input signal applied thereto;
(b) bi-directional transmission means having a progressive path for transmitting said excitation signal output from said excitation means as a progressive wave signal and a reflective path for feeding back said progressive wave signal to said excitation means as a reflected wave signal, said bi-directional transmission means containing delay means which delays at least one of said progressive wave signal and reflected wave signal;
(c) tone pitch information generating means for generating coefficients corresponding to tone pitch information representative of the tone pitch of a musical tone to be generated;
(d) filter means located between the progressive path and the reflective path for generating a filtered signal by changing frequency characteristics of said progressive wave signal;
(e) adding means for adding said filtered signal and said reflected wave signal to generate a new reflected wave signal; and
(f) multiplying means for multiplying said progressive wave signal by said coefficient to generate a new progressive wave signal.

7. A musical tone synthesizing apparatus according to claim 6 further providing a second multiplying means, said tone pitch information generating means further generating a second coefficient, wherein said second multiplying means multiplies one of said filtered signal and said progressive wave signal by said second coefficient.

8. A musical tone synthesizing apparatus according to claim 6 wherein said delay means comprises a multi-stage delay means which delays said progressive wave signal by desirable delay times.

9. A musical tone synthesizing apparatus according to claim 8 further including interpolation means for interpolating between plural progressive wave signals delayed by said multi-stage delay means and generating a interpolated signal, whereby said junction means transmits a interpolated signal as a new progressive wave signal.

* * * * *